United States Patent [19]

Allenbaugh

[11] 4,289,277

[45] Sep. 15, 1981

[54] CONSTANT PRESSURE NOZZLE WITH MODULATION EFFECT

[75] Inventor: George G. Allenbaugh, Wadsworth, Ohio

[73] Assignee: Premier Industrial Corporation, Cleveland, Ohio

[21] Appl. No.: 137,834

[22] Filed: Apr. 7, 1980

[51] Int. Cl.[3] ..... B05B 1/32

[52] U.S. Cl. ..... 239/452; 137/542; 239/459

[58] Field of Search ..... 239/452, 453, 456, 459, 239/571, 505, 506, 514, 524, 537, 570, 583; 137/541, 542, 543.15

[56] References Cited

U.S. PATENT DOCUMENTS

| | | | |
|---|---|---|---|
| 2,568,429 | 9/1951 | Burnam et al. | 239/452 |
| 2,796,296 | 6/1957 | Campbell | 239/452 |
| 3,684,192 | 8/1972 | McMillan | 239/452 |
| 3,863,844 | 2/1975 | McMillan | 239/452 |
| 3,904,125 | 9/1975 | Allenbaugh | 239/452 |
| 4,172,559 | 10/1979 | Allenbaugh | 239/453 |

*Primary Examiner*—Andres Kashnikow
*Assistant Examiner*—Gene A. Church
*Attorney, Agent, or Firm*—Isler and Ornstein

[57] ABSTRACT

An automatically regulated constant-pressure fire-fighting nozzle having a pressure-responsive baffle element for adjusting the size of the discharge orifice in response to supply pressure changes. An upstream-directed baffle extension in opposition to the direction of fluid flow for creating a low-pressure zone adjacent said baffle element in response to high supply volume to modulate the effective displacement force acting on the orifice-regulating baffle element. The extension also serving to adjustably restrict the fluid flow passage to said orifice in response to pressure-induced displacement of said baffle element.

10 Claims, 3 Drawing Figures

Fig. 1
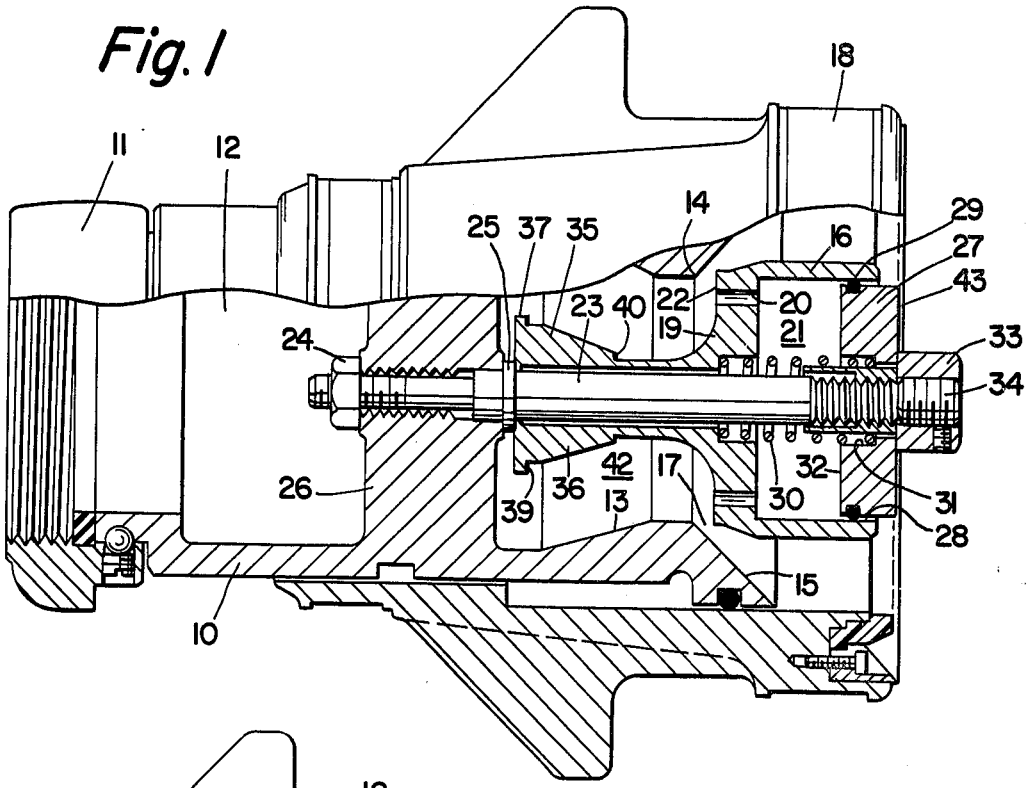
Fig. 2
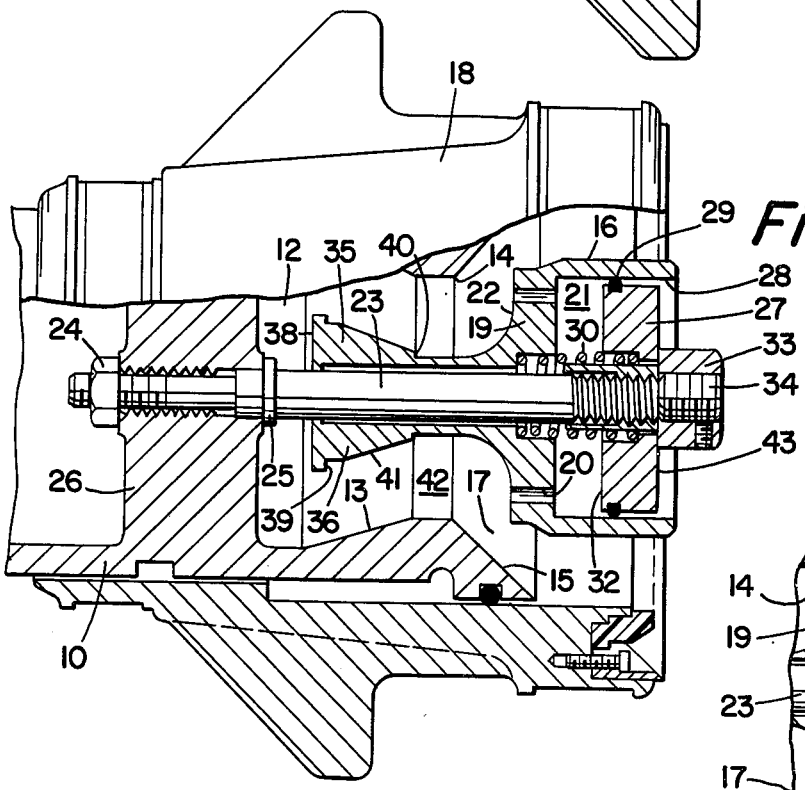
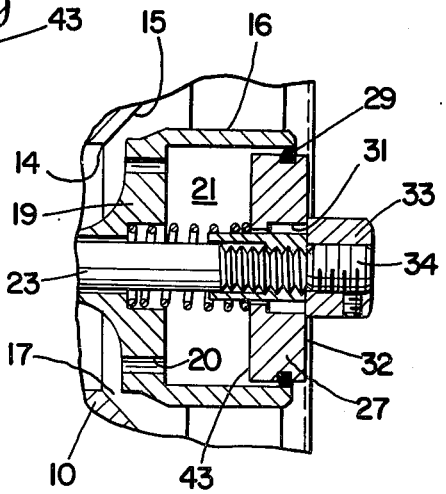
Fig. 3

CONSTANT PRESSURE NOZZLE WITH MODULATION EFFECT

BACKGROUND OF THE INVENTION

The invention relates to fire-fighting fluid discharge nozzles and, more particularly to mechanism for maintaining a substantially constant discharge pressure at the orifice of such nozzles as the supply volume or pressure varies. Examples of such constant-pressure nozzles can be found in McMillan U.S. Pat. No. 3,863,844; Burnam et al. U.S. Pat. No. 2,568,429 and Allenbaugh U.S. Pat. No. 3,904,125. All of these prior art patents utilize a yieldably-mounted pressure-responsive baffle to progressively enlarge the nozzle discharge orifice or opening as fluid pressure or volume in the nozzle increases. The enlargement of the orifice permits a greater volume of discharge to relieve the increased pressure in the nozzle, and thereby attempts to achieve constancy in the discharge pressure.

The discharge pressure affects the reach of the fire-fighting stream. To maintain a desirable uniformity in the reach of the stream, a uniformly maintained discharge pressure is required. That is the objective of automatically self-regulating constant-pressure nozzles of the type mentioned above.

However, it has been found that, although most of such pressure-regulating mechanisms are reasonably effective within a very narrow range of operating pressures, they are characterized by increasingly larger deviations from the desired pressure-constancy as the high-volume limits of operation are approached. Under such circumstances, the straight-line response fails to maintain constancy of pressure, and the mechanisms, by nature of their operating structure, tend to cover a pressure range which is broader than desirable.

The straight-line response problem was addressed in Allenbaugh U.S. Pat. No. 3,904,125 by substituting a special tubular resilient element for the conventional coil spring, and thereby obtaining an improved load-deflection characteristic and greater sensitivity of response.

Another solution to the response problem was presented in Allenbaugh U.S. Pat. No. 4,172,559 by use of a contained piston so arranged as to inhibit the effect of pressure on the orifice-sizing baffle element as the higher operating gallonage limits are approached.

SUMMARY OF THE INVENTION

It is a primary object of the present invention to provide a simplified, yet highly effective, means for modulating the baffle responsiveness of spring-loaded, pressure-regulating nozzles to achieve a substantial constant-pressure characteristic over the entire range of operating pressures, including the high pressure limits of the range.

A further object of the invention is to provide a baffle structure of the character described which can be utilized over a much broader range of operating pressures than prior art devices.

Other objects and advantages will become apparent during the course of the following description and with reference to the following drawings in which like numerals are used to designate like parts throughout the same.

BRIEF DESCRIPTION OF THE DRAWINGS

FIG. 1 is a longitudinal cross-sectional view of a nozzle structure embodying the invention.

FIG. 2 is a fragmentary enlarged portion similar to FIG. 1, showing the position of the parts after high-pressure displacement.

FIG. 3 is a fragmentary cross-sectional view showing the alternative disposition of the piston for another range of operating pressures.

DESCRIPTION OF THE PREFERRED EMBODIMENTS

Referring to FIG. 1, a nozzle body 10 is provided, at one end thereof, with a conventional coupling member 11 adapted to secure the nozzle to a hose or other source of pressure water supply. The nozzle body has a central water flow passageway 12 which, by means of an inwardly-tapered or convergent body wall 13, is gradually restricted or diminished in flow area to a point of restriction defining a discharge opening or orifice 14. The orifice 14 leads into a conical or divergently-extending throat 15 which, in combination with a baffle element 16, defines a variable flow discharge passageway 17. By means of an adjustably-mounted sleeve 18 on the body 10, the fluid discharge from passageway 17 is formed into a desired spray or other discharge pattern, as is known in the art.

The baffle element 16 is a hollow cylinder having a closed upstream end 19 which is perforated, as indicated at 20, with one or more openings which provide hydraulic communication between the interior 21 of the baffle cylinder and the fluid flow upstream and exteriorly thereof.

The end 19 presents a pressure-responsive face or surface 22 to the discharge flow in the nozzle body, which exerts a displacing force tending to move the baffle cylinder 16 downstream and further away from the divergent walls of the throat 15, so as to enlarge the discharge passageway 17.

To permit such pressure-responsive displacement of the element 16, it is slidably mounted on a shaft or rod 23 which extends centrally and longitudinally of the body flow passageway 12. The rod 23 is secured fixedly within the body 10 by means of a nut 24 which clamps a shouldered portion 25 of the rod against a spider structure 26 formed within the body.

The opposite end of the rod 23 has a piston 27 slidably mounted thereon so as to seal the open end 28 of the cylinder and slidably engage the interior thereof, as by means of sealing ring 29.

A coil spring 30 has one end thereof seated in a recess 31 in one face 32 of the piston, and has its other end bearing against the cylinder so as to yieldably maintain the cylinder spaced from the piston. A nut 33 threadedly engages the end 34 of the rod exteriorly of the piston to provide an abutment limiting outward, spring-induced movement of the piston.

Rearwardly or upstream of the baffle element 16, the cylinder is provided with an integrated extension 35 which includes a tapered stem 36, which diverges in the upstream direction, and terminates in a disk-like enlarged head portion 37 presenting a second pressure-responsive surface or baffle face 38. It will be noted that there is an abrupt step or shoulder 39 formed at the juncture of the taper and the head 37, as well as a step or shoulder 40 at the smaller end of the taper 41.

In FIG. 1, the described parts are illustrated in the "at rest" position, such as exists when there is no fluid flow through the nozzle passageway 12 or when fluid flow is just initiated. When fluid flow commences, the water discharges through the orifice 14, but there is initially insufficient fluid pressure to cause displacement of the baffle element. As the volume and pressure of the supply water increases, it creates an increasing force on the baffle faces 22 and 38 which, when sufficient to overcome the opposition of the coil spring 30, causes downstream displacement of the baffle element 16 to enlarge the flow passageway 17 and thereby maintain the discharge pressure within a predetermined narrow operating range. If, for any reason, the supply pressure or gallonage increases further, it causes greater displacement of the baffle element and further compression of the spring 30 to further enlarge the flow passageway 17 and thereby maintain the desired constant discharge pressure of the fluid.

It will be noted that the openings 20 provide pressure-equalizing ports, so that the effective pressure-induced force on the baffle element 16 is reflected in the differential between the interior and exterior areas of the cylinder which are exposed to like pressure. This effective displacing force is considerably smaller in magnitude than the force to which the element 16 would be subjected if the pressure-equalizing ports were not provided. This smaller effective force permits the use of a weaker spring 30, with greater sensitivity of response than would be the case if a stronger and heavier spring 30 were required, in the absence of the equalizing ports 20.

The sensitivity of response is further enhanced by the use of sized openings 20 which, when made small enough, will meter the flow to cause a slight, but deliberate, time lag in the pressure-equalizing function and thereby magnify the effective force differential for faster response to abrupt pressure changes, particularly increases. The appropriate size of the ports 20 can be empirically determined to achieve the desired enhanced sensitivity of response within the operating range of discharge pressure.

It is an inherent characteristic of the load-deflection curves of conventional compression coil springs, such as spring 30, that there is a straight line or linear response to load, so that there is a uniform rate of response to pressure variations. This characteristic adversely affects the constantpressure operation of the nozzle when operating pressure fluctuations occur to change the effective displacing force on the baffle element. As fully explained with reference to FIG. 3 of the previously mentioned U.S. Pat. No. 4,172,559, the straight line load-deflection curve of the spring results in inadequate displacement of the baffle element to maintain a reasonably constant pressure.

The stepped baffle extension 35 has a dual function in overcoming or minimizing the above-described problem of coil spring straight line reaction. Its primary function is to present the steps or recesses 39 and 40 adjacent to the mainstream path of flow of water through nozzle passageway 12 and thereby, in accordance with Bernoulli's principle, create a low-pressure area by turbulence and slip-stream effect which will diminish the back pressure on surfaces 39 and 40 to modulate the effective displacing pressure on the baffle element to increase the displacing force as flow volume increases. Although both steps or recesses 39 and 40 contribute to creating the low pressure zone affecting the displacing force on baffle 16, the recess 40 is deliberately positioned radially inward of the step 39 to prevent excessive and counter-productive modulation of the fluid pressure. The smooth, connecting taper 36 also contributes to this function. The proper balance between the radial positions of the steps 39 and 40 can be empirically determined. Thereby, the full effect of such higher pressures on the baffle element 16 is modulated so as not to be translated entirely into increased displacing force. As a result, the deflection load on spring 30 does not change at the same rate as it would if a straight line response existed, and the over-deflection of the spring is avoided or minimized.

Secondly, as baffle element 16 is increasingly displaced as a result of higher forces, the head 37 of the extension 35 is simultaneously displaced, as is the shoulder 40. This downstream movement of head 37 and shoulder 40 brings it into closer proximity to the converging wall 13 and diminishes the area of the flow passageway to increase flow velocity and further reduce the fluid pressure in this area which affects the displacing force on the baffle surface 22. The higher the pressure and the greater the fluid velocity and baffle displacement, the greater is this extension-created restriction of the nozzle flow passageway 12. This flow restriction and velocity-increasing action of the baffle extension upstream of the orifice 14 further modulates the high-pressure effect on baffle 16 and minimizes baffle over-reaction and excessive orifice opening in the upper zone of the supply range.

FIG. 2 shows the position of the parts in response to a high supply pressure condition, as above described. The reference numeral 42 indicates the general area in which the low pressure zone is created by the baffle extension 35. The enlarged discharge passageway 17 resulting from displacement of the baffle element 16 is clearly evident when compared with the at rest position of the parts shown in FIG. 1.

The increases sensitivity of response achieved by the sized pressure-equalizing ports 20 and the modulating effect on high volume displacement achieved by the dual functions of the baffle extension, serve to produce an improved uniformity and constancy in the automatic regulation of discharge pressure at the nozzle.

In FIG. 3 of the drawings, a modified form of the invention is shown in which the same parts are utilized for operation in a volume operating range which is considerably higher than previously described. The position of the piston 27 is reversed so that its face 32 is exterior of the cylinder. Instead of seating in the recess 31, the coil spring 30 bears against the non-recessed opposite surface 43 of the piston. This re-arrangement of the piston causes a considerably greater initial compression or pre-loading of the coil spring 30 thereby substantially increasing the pressure required to initiate displacement of the baffle element 16 in opposition to the spring. Thereby, the same parts can be utilized for two entirely different pressure ranges simply by reversal of the piston position. Although the surface 43 has been illustrated as non-recessed, a shallow spring-receiving recess could be provided, and the described reversal of the piston position would still serve for the described function.

It will be apparent that minor adjustments in the calibration of the constant operating pressure of the discharge fluid can be accomplished by manipulation of the nut 33 on threaded end 34 of the rod to increase or decrease the pre-loading of the spring.

It will also be evident that, as no seal is provided between the rod 23 and the piston 27, there can be sufficient leakage therebetween to permit any necessary bleeding or venting of the interior 21 of the baffle cylinder.

It is to be understood that the forms of this invention, herewith shown and described, are to be taken as preferred examples of the same and that various changes in the shape, size and arrangement of the parts may be resorted to without departing from the spirit of the invention or the scope of the subjoined claims.

Having thus described my invention, I claim:

1. In an automatic pressure-regulating mechanism for a flow nozzle, the combination of:

a nozzle body presenting a discharge orifice, a piston rod fixedly secured within said body and extending downstream therein, an open-ended baffle cylinder slidably mounted on said piston rod for reciprocable movement thereon relatively to said orifice, said cylinder having a closed end in the path of fluid flow discharge through said nozzle body, said cylinder having an opposite open end downstream of said closed end and out of the path of fluid flow through said body, a piston slidably contained in the open end of said cylinder and secured to said rod, spring means interposed between said piston and said cylinder to yieldably maintain said baffle cylinder in a predetermined orifice-restricting position, said closed end of said cylinder presenting a pressure-responsive first baffle face to the fluid flow, whereby said cylinder is displaced in opposition to said spring to enlarge said discharge orifice in response to increased fluid pressure thereon, an extension provided on said cylinder upstream of said first baffle face and presenting a second baffle face opposed to the direction of fluid flow and movable with said cylinder, and a stem connecting said first baffle face to said second baffle face by a stepped portion to create a low-pressure zone between said faces in response to discharge fluid flow, whereby to modulate any increased displacing force on said first baffle face in response to increased fluid pressure in said nozzle body.

2. A combination as defined in claim 1, wherein said stem is convergently tapered downstream of said second baffle face and toward said first baffle face.

3. A combination as defined in claim 1, wherein tapered walls are provided on said nozzle body to define a progressively-adjusted smaller path of fluid flow to said orifice in response to pressure-induced downstream displacement of said cylinder extension.

4. A combination as defined in claim 1, wherein a fluid flow passageway is provided through said closed end of said cylinder for communicating fluid pressure between the interior of said cylinder and the exterior of said closed end.

5. A combination as defined in claim 4, wherein said fluid flow passageway is sized to a dimension which creates a deliberate time lag in fluid pressure communication between said interior and exterior portions of said cylinder to create a larger pressure differential therebetween in response to sudden changes in discharge flow through said nozzle body.

6. A combination as defined in claim 1, wherein an adjusting element is provided on said rod exteriorly of said piston for selectively pre-loading said spring for calibration thereof within the operating range of said mechanism.

7. A combination as defined in claim 1, wherein said nozzle body presents a divergently-tapered discharge orifice operatively associated with said cylinder.

8. In an automatic pressure-regulating mechanism for a flow nozzle, the combination of:

a nozzle body presenting a divergently-tapered discharge orifice, a piston rod fixedly secured within said body and extending downstream therein, an open-ended baffle cylinder slidably mounted on said piston rod for reciprocable movement thereon relatively to said orifice, said cylinder having a closed end in the path of fluid flow discharge through said nozzle body, a flow-metering fluid passageway provided in said closed end for communicating fluid pressure between the interior and exterior of said cylinder, said cylinder having its open end downstream of said closed end and out of the path of fluid flow through said body, a piston slidably mounted in said open end of said cylinder and secured to said rod, spring means interposed between said piston and cylinder to yieldably maintain said baffle cylinder in a predetermined orifice-restricting position, said closed end of said cylinder presenting a pressure-responsive first baffle face to the fluid flow, whereby said cylinder is displaced in opposition to said spring to enlarge said orifice in response to increased fluid pressure thereon, an extension provided on said cylinder extending upstream of said first baffle face and providing a second baffle face opposed to the direction of fluid flow and movable with said cylinder, at least one shouldered recess provided on said extension intermediate said first and second baffle faces to present a turbulence-creating low-pressure path of fluid flow in a zone adjacent said first baffle face, a tapered stem interconnecting said first and second baffle faces within said low-pressure zone, whereby to modulate any increased displacing force on said first baffle face in response to increased fluid pressure in said nozzle body, and tapered walls provided on said nozzle body to define a progressively-adjusted smaller path of fluid flow to said orifice in response to pressure-induced downstream displacement of said cylinder extension.

9. A combination as defined in claim 8, wherein said piston has a spring-receiving depression on one surface thereof and a spring-receiving seat on the opposite surface thereof, and means for selectively mounting said piston within said closed end with either surface thereof engaging said spring, whereby to pre-load said piston to one operating pressure range or a completely different operating pressure range by reversal thereof.

10. A combination as defined in claim 8, wherein a plurality of shouldered recesses are provided in longitudinally-spaced relationship on said extension, and each of said shouldered recesses is disposed radially inwardly of the next adjacent upstream shouldered recess on said extension.

* * * * *